United States Patent [19]

Burgin

[11] 4,232,416

[45] Nov. 11, 1980

[54] PROCESS FOR WETTING FIBER

[75] Inventor: Charles W. Burgin, Columbus, Ga.

[73] Assignee: Morton Machine Works, Incorporated, Columbus, Ga.

[21] Appl. No.: 29,774

[22] Filed: Apr. 13, 1979

[51] Int. Cl.[3] ..... D06B 5/12

[52] U.S. Cl. ..... 8/156; 68/184; 68/195; 162/60

[58] Field of Search ..... 8/156, 157, 158; 68/181 R, 184, 187, 189, 194, 195, 199, 205 R, 5 D; 162/60, 65

[56] References Cited

U.S. PATENT DOCUMENTS

| | | | |
|---|---|---|---|
| 2,264,828 | 12/1941 | Crum | 68/184 X |
| 2,391,096 | 12/1945 | Knight | 68/205 R X |
| 3,668,063 | 6/1972 | Engstrom | 162/65 X |
| 3,934,432 | 1/1976 | Fleissner | 68/5 D |
| 3,938,206 | 2/1976 | Stranger-Johannessen | 8/156 |

FOREIGN PATENT DOCUMENTS

| | | | |
|---|---|---|---|
| 404370 | 1/1934 | United Kingdom | 68/184 |

*Primary Examiner*—Philip R. Coe
*Attorney, Agent, or Firm*—Jennings, Carter & Thompson

[57] ABSTRACT

Disclosed is a process and apparatus for wetting textile fibers and the like. The process comprises supporting a mass of fiber to be wetted upon an air and water permeable support, the support being mounted between the closed bottom and the open upper end of a kier or the like. With a mass of fiber in place, liquid such as water or the like is applied to the top of the mass of fiber. This forces the occluded air out of the fiber in a downward direction and this air is removed from beneath the support. The disclosed apparatus is capable of carrying out the foregoing process. Essentially, the kier is provided with a vent to atmosphere just below the bottom of the support. A supply of liquid is maintained in the bottom of the kier and a pump is provided to supply this liquid to the top of the mass of fiber, for wetting the same.

1 Claim, 4 Drawing Figures

FIG. 2
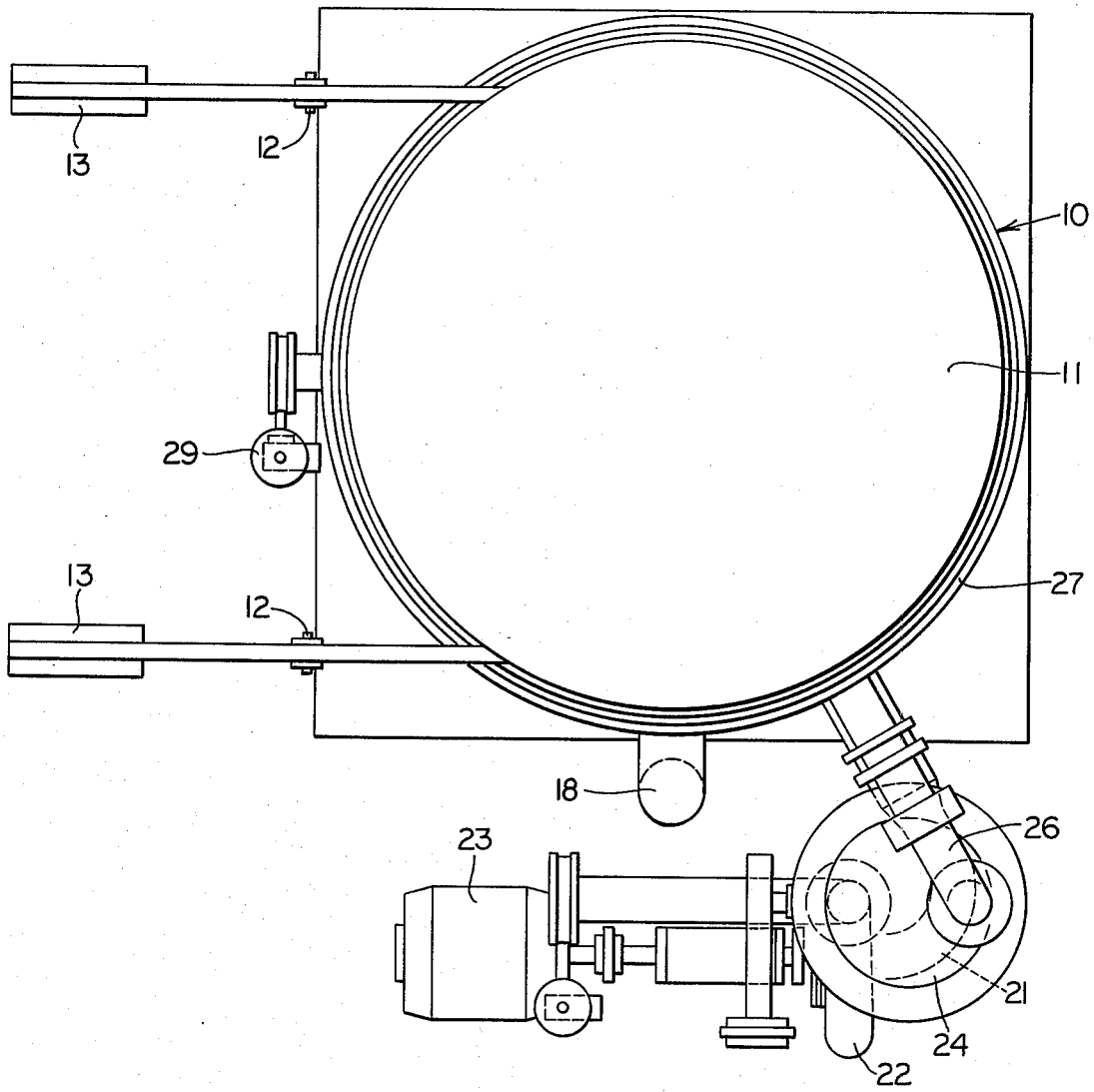
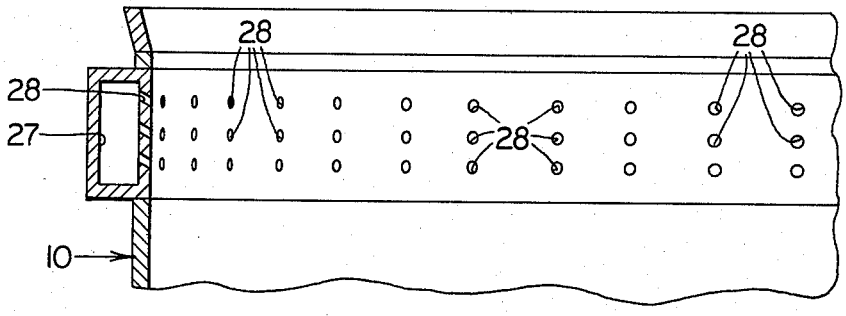
FIG. 4

PROCESS FOR WETTING FIBER

This invention relates to a process for wetting textile fibers, such for instance, as wetting prior to dyeing the fibers.

In this art it has long been the custom to wet textile fibers by placing them in a vessel such as a kier containing a quantity of water. As will be understood, the fiber contains a mass of occluded air and in order to wet the same it is necessary for this air to be displaced by the liquid. Thus, the fiber mass floats on the liquid, as the wetting process has heretofore been practiced. This means that as more fiber is added the taller the column or mass becomes, and in practice the mass builds up to the point that a portion of it is above the level of the open top of the vessel. This requires the liquid to be drained from the vessel and the process started over again.

It will be understood that heretofore it has been the practice in this art to attempt to remove the occluded air from the top of the mass of fiber either by: (a) permitting water to travel upwardly through the mass of fiber by capillary attraction; or, (b) by causing the air to become suspended in the liquid and discharging the air at the top of the kier. In either instance frequent air locking of the pump occurs and if enough water is employed, the stock floats.

My improved process contemplates supporting a mass or column of fiber on an air and liquid permeable plate or support member which support member is located above the bottom of a kier. Immediately below the support I provide a vent through the side wall of the kier to atmosphere. This vent is of such size and so located as to leave room in the bottom of the kier for a supply of the wetting liquid. A pump is connected to draw the liquid from the bottom of the kier and to spray it by means of a dispersion pipe or tube down onto the column of fiber in the kier. Thus, as the water soaks the fiber from the top of the column downwardly, air entrapped in the fiber is discharged or forced from the bottom of the fiber mass through the support and then is vented to atmosphere through the vent in the side of the kier. At the same time, liquid which originally was in the bottom of the kier after passing through the fiber is retained in the process.

From the foregoing discussion so far given it will be seen that with my improved process it is not necessary to drain or partially drain the kier each time fiber is added as has been true with the prior processes and apparatus. It is never necessary to drain or partially drain the kier with my improved process because the fiber does not float on the liquid since the fiber is supported above any body of liquid present, namely, the liquid in the bottom of the kier, below the vent. Furthermore, air locking of the pump is eliminated.

Apparatus which may be used to carry out my improved process is shown in the accompanying drawings forming a part of this application in which:

FIG. 2 is a plan view;

FIG. 4 is an enlarged detail sectional view taken generally along line 4—4 of FIG. 1.

Figure 1:
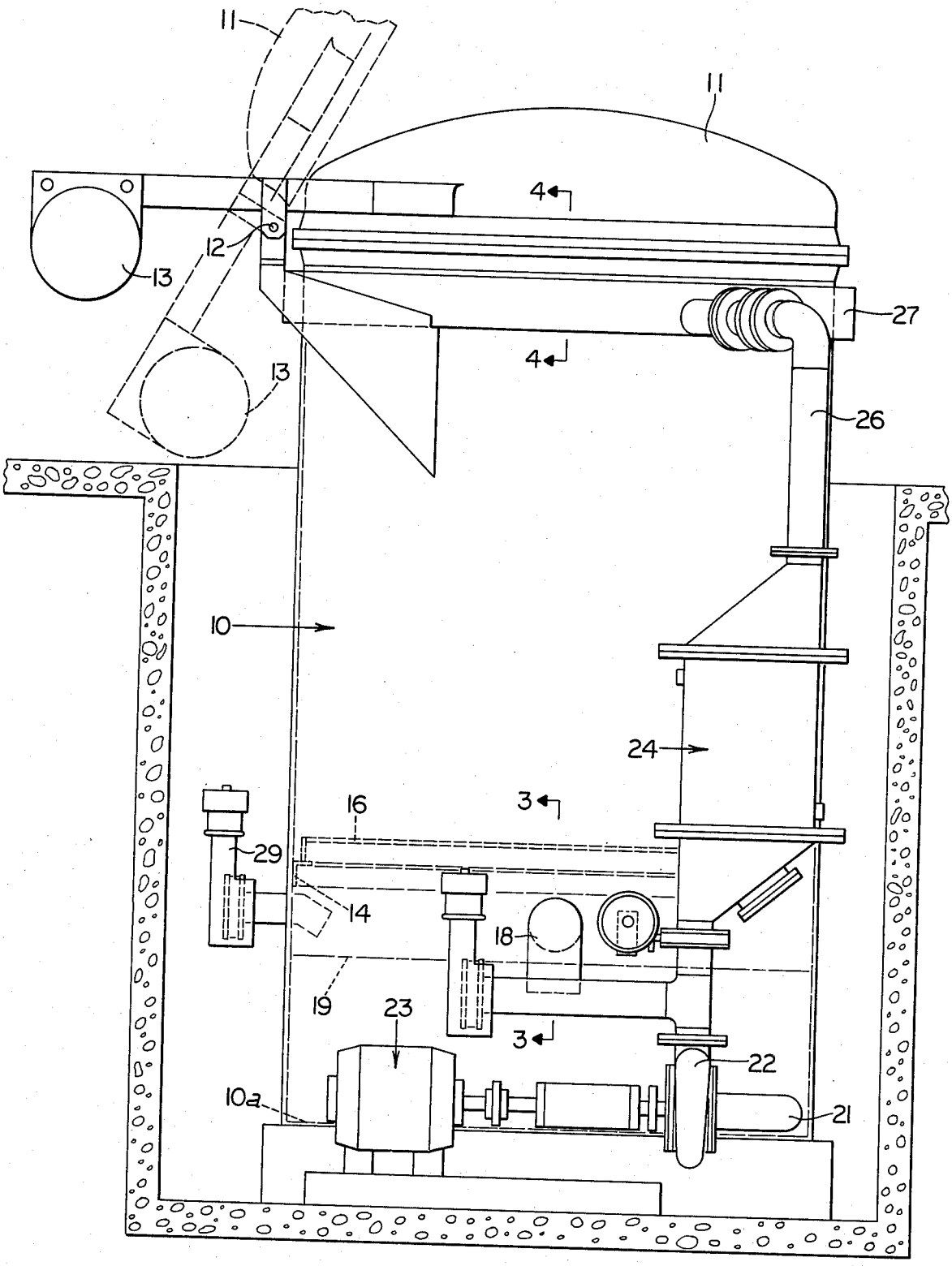
FIG. 1 is a side elevational view of my improved apparatus with the cover closed.
Figure 3:
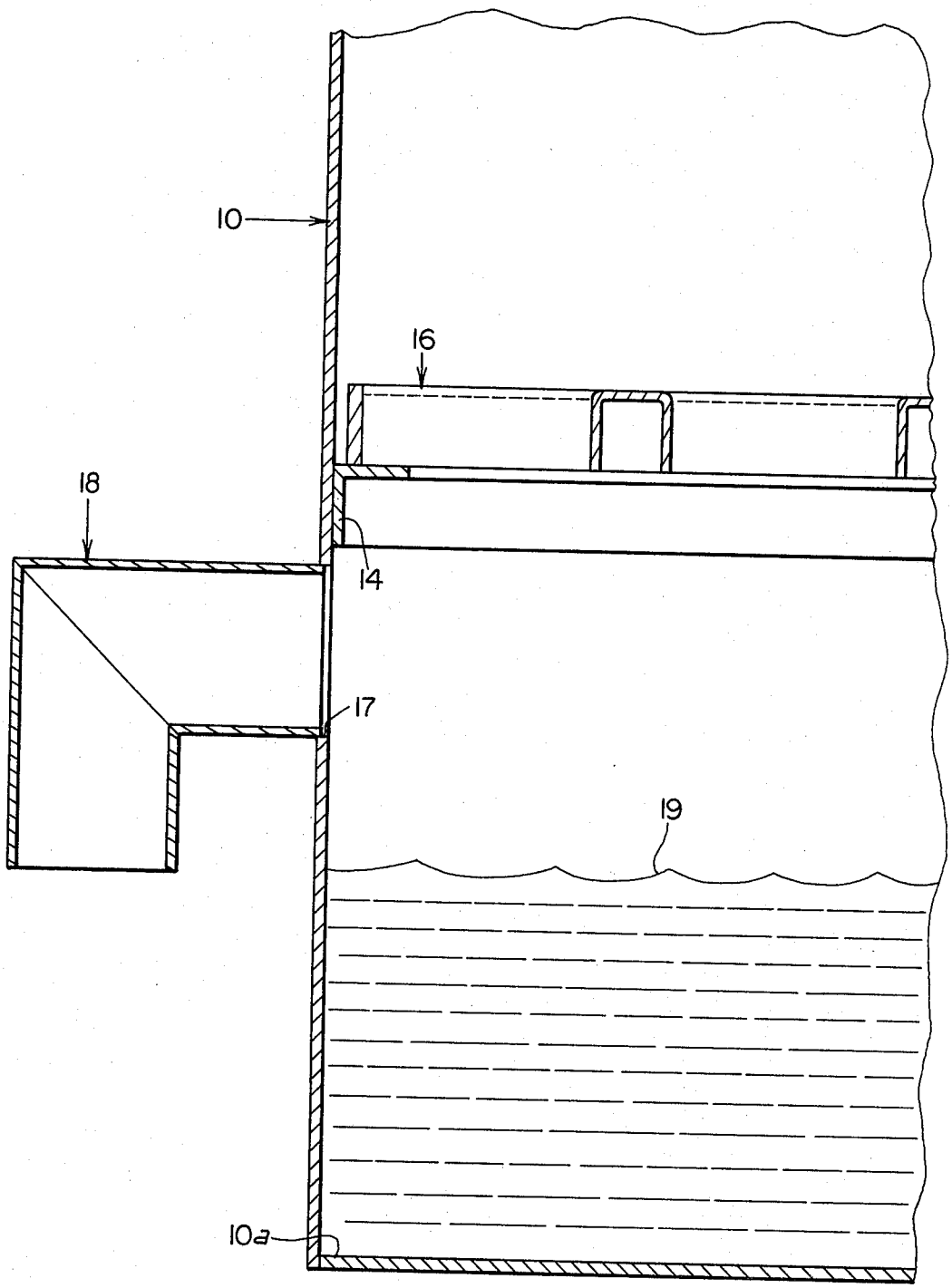
FIG. 3 is an enlarged fragmental detail sectional view taken generally along line 3—3 of FIG. 1.

Referring now to the drawings for a better understanding of my invention I will first describe the constructional features thereof and then describe how this particular apparatus may be used to carry out my improved process.

In the drawings I show a kier 10 which may be a vessel on the order of six feet in diameter by ten feet high. As is understood in the art, the kier may be provided with a removable cover 11, hinged at 12. Suitable counter-weights 13 may be used to aid in raising the cover 11 to the dotted line position of FIG. 1.

Inside the kier, by way of example, about three feet from the closed bottom 10*a* thereof, I may provide a peripherally extending angle member 14 which may be secured to the inside of the kier as by welding. Removably supported on this angle member 14 is an air and water pervious fiber support member 16.

Immediately below the member 14 is an opening 17. This opening may be vented to atmosphere through a right angle conduit 18. It will be noted that the opening 17 is considerably above the bottom of the kier so that in the closed bottom thereof there may be maintained a supply of liquid up to, for instance, the line 19 shown in FIG. 1 of the drawings.

At 21 I show a conduit which is adapted to be connected to the intake of a pump 22. The pump 22 is powered by a motor 23. Liquid is forced upwardly, preferably through a heater 24, thence through a conduit 26 and then into a dispersion ring or tube 27 located adjacent the top of the kier. The pipe 27 has openings 28 therein through which the liquid is directed downwardly onto a mass of fiber resting on the support member 16.

From the foregoing it is now possible to explain more in detail my improved process and the advantages thereof, as well as the advantages of my improved apparatus.

In starting the operation, a quantity of liquid, such for instance as water, is placed in the bottom of the kier as indicated, this being admitted through a fill water valve 29. See FIG. 1. The cover 11 is now opened and the kier is filled to the top with the dry fiber to be wetted. It will be seen of course that this fiber is resting on the support member 16. The pump is now started, with the lid still open, and liquid is drawn from the bottom of the kier and delivered through the openings 28 onto the top of the mass of dry fiber. As the mass becomes wetted, the air in the interstices between the fibers is forced downwardly, passing thorugh the support member 16 and being expelled through the vent or opening 17 to atmosphere. As the water finally permeates the entire mass of fiber the excess drains back into the bottom of the kier. As is understood, when the fiber becomes wetted its volume shrinks and therefore additional dry fiber can be added to the top of the mass in order to get a full weight of fiber to be sent to the dyeing apparatus. Therefore, additional dry fiber is placed on that which has already been wetted, with the pump still running. Finally, when the correct poundage of fiber has been placed in the apparatus (and this is enough wetted fiber substantially to fill the kier above the support 16) the lid is closed and the liquid is circulated through the fiber by building a head of liquid in the space remaining on top of the fiber. This of course forces liquid under pressure through the entire, full weight mass, assuring that all pockets of air are removed from the mass, consequently assuring that all of the fibers are properly wetted. After proper wetting the now wetted mass is removed by removing the support member by any suitable means.

From the foregoing it will be seen that my improved process and the apparatus for carrying the same out depart radically from the process heretofore used for wetting fibers. Thus, instead of floating a mass of fiber on liquid and trying to wet it from below, my improved process proceeds precisely in the opposite direction, namely, that I support the fiber out of contact with the liquid and supply the liquid onto the top of the fiber while expelling from the bottom of the mass occluded air as it is displaced by the liquid. If it were not for venting the tank to atmosphere below the level at which the fiber is supported, pressure would build up in the bottom of the tank, making it much more difficult for the water to pass down through the fibers for wetting them. Therefore, my improved process and apparatus saves both time and liquid inasmuch as a full weight, for instance 3,000 pounds, of dry fiber can be wetted in a fraction of the time required heretofore. Furthermore, with my improved process none of the wetting liquid is wasted as it is used over and over again.

While I have shown my invention in but one form, it will be obvious to those skilled in the art that it is not so limited but is susceptible of various changes and modifications without departing from the spirit thereof.

What I claim is:

1. The process of wetting masses of fiber comprising:

(a) supporting a mass of fiber to be wetted on a generally horizontally disposed, air and liquid permeable member located intermediate the upper end and closed bottom of a vessel, (b) supplying liquid to the upper surface of the fiber mass whereby it flows downwardly, displacing entrapped air in the fiber mass and discharging it from the bottom of the fiber mass, (c) collecting in the bottom of the vessel liquid which flows through the mass and recirculating at least a portion of the same through the fiber mass, and (d) venting from the vessel air displaced from the fiber mass at a point below the fiber mass and above the level of the liquid which collects in the bottom of the vessel.

* * * * *